US010753716B2

(12) United States Patent
Grunder et al.

(10) Patent No.: US 10,753,716 B2
(45) Date of Patent: Aug. 25, 2020

(54) WARHEAD

(71) Applicant: SAAB BOFORS DYNAMICS SWITZERLAND LTD., Thun (CH)

(72) Inventors: Bruno Grunder, Heimberg (CH); Markus Conrad, Thun (CH); Christian Herren, Liebefeld (CH)

(73) Assignee: Saab Bofors Dynamics Switzerland Ltd., Thun (CH)

( * ) Notice: Subject to any disclaimer, the term of this patent is extended or adjusted under 35 U.S.C. 154(b) by 1 day.

(21) Appl. No.: 16/068,188

(22) PCT Filed: Jan. 15, 2016

(86) PCT No.: PCT/CH2016/000007
§ 371 (c)(1),
(2) Date: Jul. 5, 2018

(87) PCT Pub. No.: WO2017/120686
PCT Pub. Date: Jul. 20, 2017

(65) Prior Publication Data
US 2019/0025030 A1 Jan. 24, 2019

(51) Int. Cl.
*F42B 12/22* (2006.01)

(52) U.S. Cl.
CPC ..... *F42B 12/22* (2013.01)

(58) Field of Classification Search
CPC ..... F42B 12/22; F42B 12/44; F42B 12/24; F42B 12/32
USPC ..... 102/473, 45, 475, 491–497
See application file for complete search history.

(56) References Cited

U.S. PATENT DOCUMENTS 723,256 A * 3/1903 Emery ..... F42B 12/32 102/494
791,679 A * 6/1905 Edmunds ..... F42B 12/32 102/495
1,006,875 A * 10/1911 Puff ..... F42B 12/32 102/494
1,256,762 A * 2/1918 Apostoloff ..... B22D 19/0054 164/109
3,815,504 A * 6/1974 Tieben ..... F42B 12/32 102/496
3,945,321 A * 3/1976 Mayer ..... F42B 12/32 102/496
4,129,061 A * 12/1978 Bedall ..... F42B 12/32 102/496
4,327,643 A * 5/1982 Lasheras Barrios .... F42B 12/32 102/473

(Continued)

FOREIGN PATENT DOCUMENTS

DE 19648355 A1 7/1999
GB 1171362 A 11/1969

*Primary Examiner* — Joshua E Freeman
(74) *Attorney, Agent, or Firm* — Rankin, Hill & Clark LLP

(57) ABSTRACT

Warhead (1) comprising a tubular structure comprising: a front end (15) and a front region (2) adjoining the front end (15); a rear end (14) and a rear region (3) adjoining the rear end (14); a central axis (11) connecting the front end (15) and the rear end (14); a wall portion (4); and a central cavity (6), whereby the outer wall portion (4) tapers in the front region (2) and comprises fragments (7; 9) in the rear region (3) and the tubular structure in the rear region (3) comprises a generally cylindrical portion (12) and a generally conical portion (13) relative to the central axis.

16 Claims, 2 Drawing Sheets

(56) References Cited

U.S. PATENT DOCUMENTS

| | | | | | |
|---|---|---|---|---|---|
| 4,592,283 | A * | 6/1986 | Hellner | F42B 12/22 | 102/493 |
| 4,644,867 | A * | 2/1987 | Hellner | F42B 12/32 | 102/495 |
| 4,882,996 | A * | 11/1989 | Bock | F42B 12/32 | 102/496 |
| 5,026,169 | A * | 6/1991 | Titus | B01F 7/302 | 366/287 |
| 8,161,884 | B1 * | 4/2012 | Kokodis | F42B 12/24 | 102/476 |
| 9,759,533 | B2 * | 9/2017 | Bruno | F42B 12/32 | |
| 2003/0164108 | A1 * | 9/2003 | Ronn | F42B 12/10 | 102/473 |
| 2016/0363426 | A1 * | 12/2016 | Kerns | F42B 12/204 | |
| 2016/0370159 | A1 * | 12/2016 | Bootes | F42B 12/204 | |

* cited by examiner

WARHEAD

BACKGROUND OF THE INVENTION

1. Field of the Invention

The invention relates to a warhead.

2. Description of the Related Art

A hollow charge warhead is known from GB 1,171,362 which comprises pre-shaped fragments in the form of metal balls. However, this known warhead does not allow to choose several directions of the fragment distribution towards the target area and in particular no teaching is to be found regarding a so-called "back-spray" resp. "front-spray". Another drawback of this known warhead consist in the fact that its fragmentation casing comprising the metal balls is contained within a cylindrical housing, i.e. does not form the outer surface of the warhead, thereby diminishing the effect of the fragments.

BRIEF SUMMARY OF THE INVENTION

It is an object of the invention to provide a warhead allowing variable direction of the fragments distributed by explosion of the explosive charge of the warhead.

The invention solves the posed problem with a warhead as disclosed herein.

The advantages of the warhead according to the invention are the following:

Variability of the direction of the fragments distributed by explosion (back-spray/front-spray);

Achievement of a lens effect, providing an enhanced amount of fragments in a specific zone (is mentioned in detail below).

Further advantageous embodiments of the invention can be commented as follows:

In a special embodiment the generally cylindrical portion is arranged in the rear region between the generally conical portion and the front region relative to the central axis. This arrangement of the conical portion and the cylindrical portion allows the back spray of fragments by explosion of the explosive charge of the warhead.

In another embodiment the generally conical portion is arranged in the rear region between the generally cylindrical portion and the front region relative to the central axis. This arrangement of the conical portion and the cylindrical portion allows the front spray of fragments by explosion of the explosive charge of the warhead.

In a further embodiment the warhead comprises a reflector. This embodiment allows the reflection of the shock waves in the direction of the outer wall of the conical portion resulting in the influence of the direction of the fragments provided on the outer wall of the conical portion of the warhead.

In a further embodiment the generally conical portion is longer as the generally cylindrical portion measured parallel to the central axis.

In another embodiment the generally conical portion is shorter as the generally cylindrical portion measured parallel to the central axis.

In again another embodiment the generally conical portion and the generally cylindrical portion are equal long measured parallel to the central axis.

In a further embodiment the hollow generally conical portion has a full cone angle of $\varphi_2$ being at least 4 degrees, preferably 6 degrees.

In a further embodiment the hollow generally conical portion has a full cone angle of $\varphi_2$ being at most 30 degrees, preferably 20 degrees.

In a further embodiment the warhead comprises a discontinuity running peripherally to the tubular structure between the cylindrical portion and the conical portion.

In a further embodiment the warhead comprises a bend between the cylindrical portion and the conical portion.

In a further embodiment the front region of the warhead does not comprise any fragments.

In a further embodiment the fragments comprise at least two different types of fragments.

In a further embodiment one type of fragments has essentially spherical shape and the other type of fragments has a non-spherical, preferably cuboid, parallelepipedic or tetrahedral shape.

In a further embodiment the at least two different types of fragments comprise different materials.

In a further embodiment the at least two different type of fragments are arranged in a single plane of the wall portion.

In another embodiment the at least two different type of fragments are arranged over each other.

In a further embodiment the fragments comprise a metal, metallic alloy or metal carbide, preferably steel, tungsten, tungsten carbide or aluminum.

Definitions

"Fragments": The term "fragments" means in the present specification any pre-shaped fragmentations or splinters made of various hard or hardenable materials.

"Reflector": The term "reflector" covers in the present specification devices changing the direction of the shock waves being produced by e.g. detonation of an explosive charge.

A BRIEF DESCRIPTION OF THE DRAWINGS

A specific embodiment of the invention will be described in the following by way of example and with reference to the accompanying drawings in which.

DETAILED DESCRIPTION OF THE INVENTION

Figure 1:
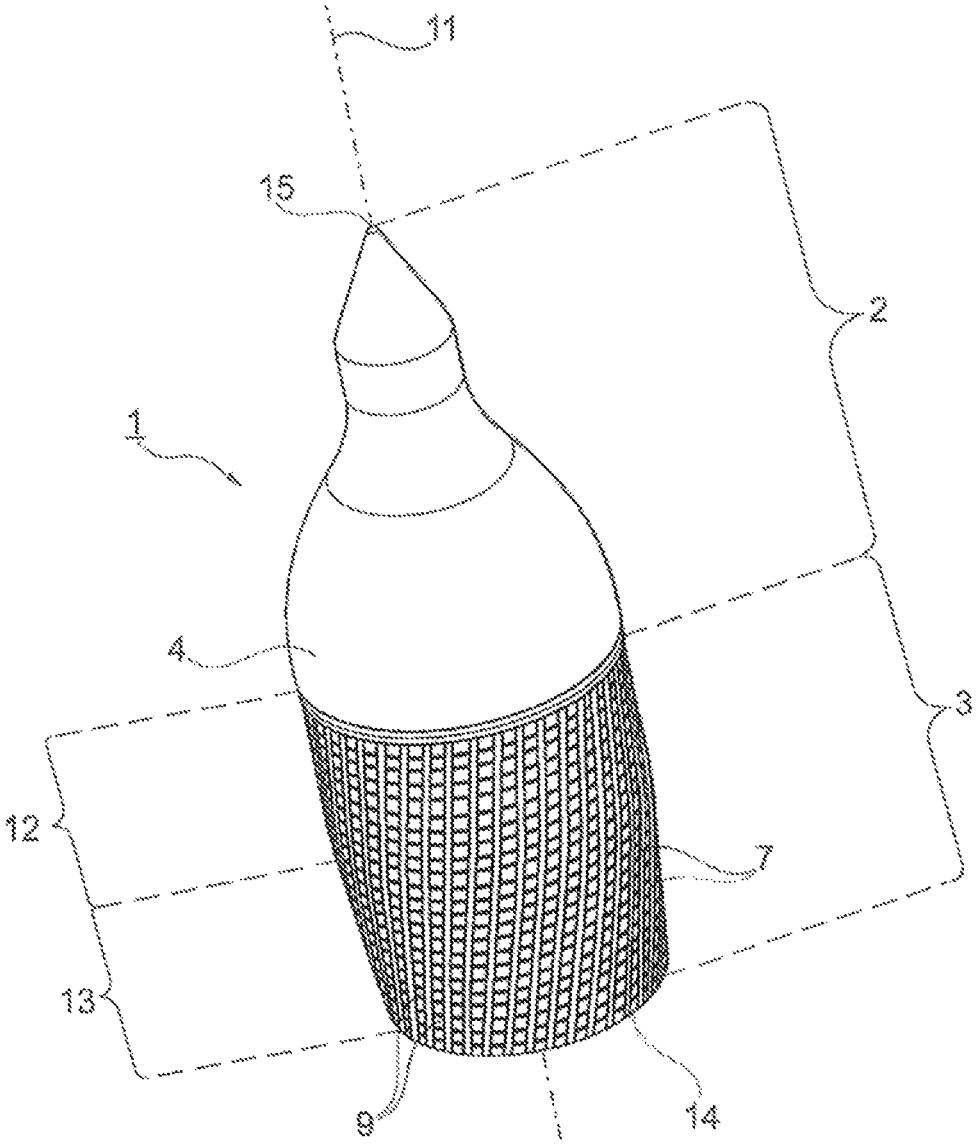
FIG. 1 illustrates a perspective view of an embodiment of the warhead according to the invention.

FIG. 1 shows a warhead 1 having a tubular structure having a front end 15, the rear end 14 and a central axis 11 connecting the front end 15 and the rear end 14. Further the tubular structure comprises a rear region 3 adjoining the rear end 14 and a front region 2 adjoining the front end 15 as well as a wall portion 4. In the front region 2 the wall portion tapers towards to the front end 15 and does not comprise any fragments. In the rear region 3 the wall portion 4 is provided with first fragments 9 having non-spherical shape and seconds fragments 7 having spherical form. The tubular structure in the rear region 3 consists of a hollow generally cylindrical portion 12 and a hollow generally conical portion 13. The conical portion is arranged between the rear end 14 and the cylindrical portion 12 and tapers towards the rear end 14.

Figure 2:
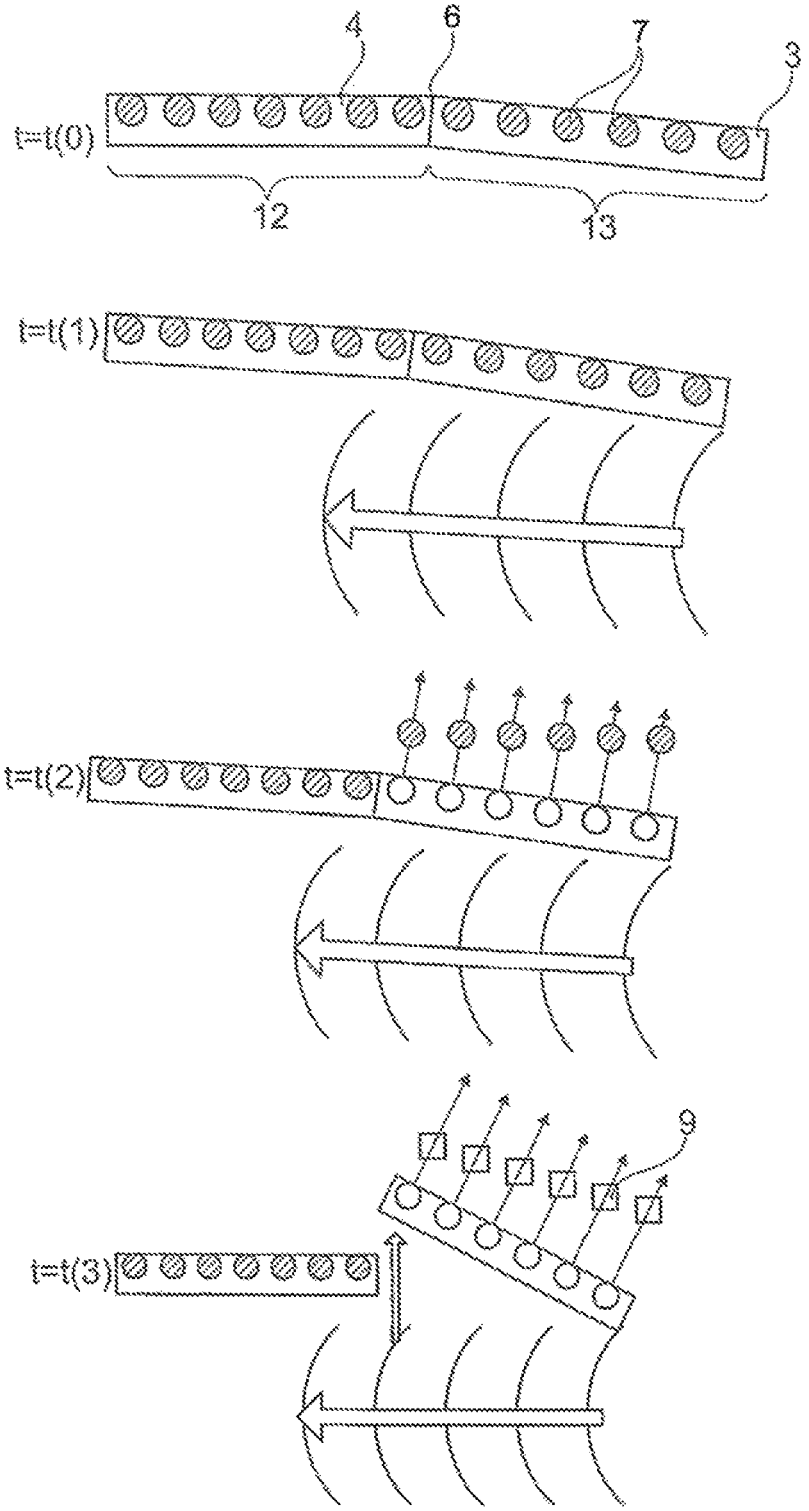
FIG. 2 illustrates schematically the wall portion of an embodiment of the warhead according to the invention in its different configuration varying on the time of detonation.

FIG. 2 shows schematically the tubular structure in the rear region 3 as well as its transformation depending on the time of the effected detonation.

The schematical illustration to time t(0) shows the starting configuration of the wall portion 4 in the rear region 3 of the tubular structure. The rear region 3 comprises the generally cylindrical portion 12 and the generally conical portion 13. The tubular structure is provided with a discontinuity 6, which in FIG. 2 is depicted as a bend at the junction between the cylindrical and the conical portions 12; 13. The wall portion 4 of the rear region 3 is provided with first fragments 9 having cuboidal shape and with the second fragments 7 having spherical shape.

The schematical illustration to time t(1) shows the kinetics at the moment when the detonation wave hits conical part of the tubular structure. Subsequently to hitting by the detonation wave the spherical fragments 7 are ejected from the wall portion 4. Subsequently to the ejection of the second fragments 7 and caused by the detonation wave the wall of the conical portion 13 of the rear region 3 splits up with the cylindrical portion 12 of the rear region 3. Subsequent to the splitting of the conical region 13 the first (non-spherical) fragments 9 are ejected from the wall portion 4 in a trajectory being different to the trajectory of the second fragments 7. The splitting-up of the conical and cylindrical regions 12 and 13 with each other results in an enhanced spray angle.

Depending on the matter whether the generally conical or the generally cylindrical portion are arranged next to the detonator/reflector back- or front-spray of the fragments can be achieved.

Furthermore, a lens effect can be achieved providing an enhanced amount of fragments in a specific zone.

Figure 3:
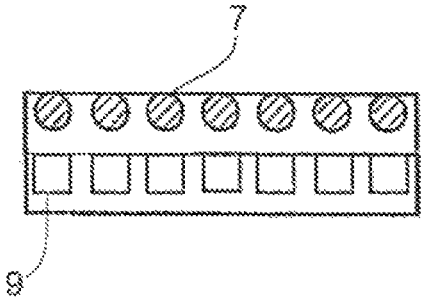
FIG. 3 shows at least two different types of fragments arranged in separate layers, one above another.

FIG. 3 shows first fragmentation or splinter elements 9 and second fragmentation or splinter elements 7 arranged in separate layers, one above another.

Figure 4:
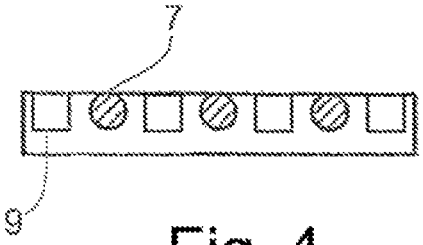
FIG. 4 shows at least two different types of fragments arranged in a single layer.

FIG. 4 shows first fragmentation or splinter elements 9 and second fragmentation or splinter elements 7 arranged in a single layer.

Although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the appended claims.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

The invention claimed is:

1. A warhead comprising a tubular structure having:

a front end and a front region adjoining the front end;

a rear end and a rear region adjoining the rear end;

a central axis extending through the front end and the rear end;

an outer wall portion; and a central cavity;

wherein the outer wall portion tapers in the front region, wherein the tubular structure in the rear region comprises a generally cylindrical portion and a generally conical portion relative to the central axis, wherein the outer wall portion, in the rear region, is provided with pre-shaped fragments, and wherein the front region does not comprise any pre-shaped fragments.

2. The warhead according to claim 1, wherein the generally cylindrical portion is arranged in the rear region between the generally conical portion and the front region relative to the central axis.

3. The warhead according to claim 1, wherein the generally conical portion is arranged in the rear region between the generally cylindrical portion and the front region relative to the central axis.

4. The warhead according to claim 1, wherein the generally conical portion is longer than the generally cylindrical portion as measured parallel to the central axis.

5. The warhead according to claim 1, wherein the generally conical portion is shorter than the generally cylindrical portion as measured parallel to the central axis.

6. The warhead according to claim 1, wherein the generally conical portion and the generally cylindrical portion are of equal length as measured parallel to the central axis.

7. The warhead according to claim 1, wherein the generally conical portion has a full cone angle of $\varphi_2$ being at least 4 degrees.

8. The warhead according to claim 1, wherein the generally conical portion has a full cone angle of $\varphi_2$ being at most 30 degrees.

9. The warhead according to claim 1, wherein the warhead comprises a discontinuity running peripherally in the tubular structure between the cylindrical portion and the conical portion.

10. The warhead according to claim 1, wherein the warhead comprises a bend between the cylindrical portion and the conical portion.

11. The warhead according to claim 1, wherein the pre-shaped fragments comprise at least two different types of pre-shaped fragments.

12. The warhead according to claim 11, wherein one of the at least two different types of pre-shaped fragments has an essentially spherical shape and another of the at least two different types of pre-shaped fragments has a non-spherical shape.

13. The warhead according to claim 11, wherein the at least two different types of pre-shaped fragments are comprised of different materials.

14. The warhead according to claim 11, wherein the at least two different types of pre-shaped fragments are both arranged in a single layer surrounding the outer wall portion.

15. The warhead according to claim 11, wherein the at least two different type of pre-shaped fragments are arranged in separate layers, one above another.

16. The warhead according to claim 1, wherein the pre-shaped fragments comprise a metal, a metallic alloy or a metal carbide.

* * * * *